United States Patent [19]

Murphy

[11] Patent Number: 5,052,202

[45] Date of Patent: Oct. 1, 1991

[54] DEAD BOLT LOCKING DEVICE

[76] Inventor: Jerry A. Murphy, 7361 E. Diamond, Scottsdale, Ariz. 85257

[21] Appl. No.: 496,793

[22] Filed: Mar. 21, 1990

[51] Int. Cl.[5] ..... E05B 13/08

[52] U.S. Cl. ..... 70/211; 70/416

[58] Field of Search ..... 70/416, 429, 430, 211; 292/288

[56] References Cited

U.S. PATENT DOCUMENTS

| | | | |
|---|---|---|---|
| 591,177 | 10/1897 | Palmer | 70/430 |
| 1,082,427 | 12/1913 | Klespies | 70/430 |
| 2,463,195 | 3/1949 | Mungan | 70/416 |
| 3,263,462 | 8/1966 | Suroff et al. | 70/211 |
| 3,423,974 | 1/1969 | Bernsley | 70/416 |
| 3,585,827 | 6/1971 | Dominguez | 70/416 |
| 3,724,246 | 4/1973 | Katsaros | 70/211 X |
| 3,927,544 | 12/1975 | Klein | 70/416 |
| 3,933,014 | 1/1976 | Moses | 70/416 |
| 4,064,721 | 12/1977 | Morgan | 70/416 |
| 4,279,137 | 7/1981 | Cook | 70/416 |
| 4,715,200 | 12/1987 | Katsaros | 70/416 X |

FOREIGN PATENT DOCUMENTS

| | | | |
|---|---|---|---|
| 15009 | 9/1881 | Fed. Rep. of Germany | 70/430 |
| 454672 | 10/1936 | United Kingdom | 70/416 |

*Primary Examiner*—Lloyd A. Gall

*Attorney, Agent, or Firm*—David G. Rosenbaum

[57] ABSTRACT

A locking device for the knob of a reciprocating dead bolt latch for a door having a head portion and downwardly extending spaced apart leg members. The head portion has an aperture adapted to engage the dead bolt latch knob in locking fashion. The leg members define a slot which engages the door knob shank or the door handle.

13 Claims, 1 Drawing Sheet

DEAD BOLT LOCKING DEVICE

BACKGROUND OF THE INVENTION

The present invention relates generally to a device for securing a dead bolt latch. More particularly, the present invention relates to a removable device which may be hung upon and secured to a dead bolt latch and prevents retraction of the dead bolt prior to removal of the device.

Conventional attempts to provide a simple and inexpensive means for providing additional security for doors have been inadequate. In U.S. Pat. No. 4,189,176, issued on Feb. 19, 1980, there is disclosed a thin flat plate which is used to restrain retraction of the dead bolt by vertically applying the plate directly to the dead bolt latch between the door and the door frame. This device is cumbersome to engage and remove. In U.S. Pat. No. 4,082,334, issued Apr. 4, 1978 there is disclosed a rigid plate having longitudinally spaced and transverse openings to receive adjacent door knobs, such as those found on adjacent opening doors commonly referred to as French Doors. This device exhibits utility only on adjacent opening doors and would have no utility on the more commonly employed single-entry doorways. Finally, U.S. Pat. No. 4,605,251, issued Aug. 12, 1986, discloses a U-shaped lock which fits around the shank of a door knob assembly having two legs which are received by an extended strike plate in a locked condition. The lock is retained around the shank by a keeper engaged on at least one of the legs. This device requires the addition of a strike plate to receive the U-shaped locking member.

There are, therefore, no known devices which are adapted to directly engage, in locking fashion, the dead bolt latch knob in order to prevent turning of the knob and retraction of the dead bolt.

SUMMARY OF THE INVENTION

Accordingly, it is a broad object of the present invention to provide a locking device which is adapted to directly engage the dead bolt latch knob to prevent turning of the knob and retraction of the dead bolt. A more specific aspect of the present invention is that the locking device is easily removable from the door, is adapted to engage a wide variety of dead bolt latches and is transportable from door to door.

The locking device is adapted for use with virtually any type of dead bolt latch system, regardless of whether the dead bolt latch is in close proximity to a door knob or a door handle. Moreover, the locking device is adapted for virtually universal use with dead bolt latch knobs having a vertical, horizontal or angular position and throw for the dead bolt latch.

These and other features and advantages of the present invention are met by a locking device having a head portion and downwardly extending spaced apart leg members. The head portion has an aperture passing through the head portion which is adapted to engage a dead bolt latch knob in locking fashion. The leg members define a slot which engages the door knob shank or the door handle.

DETAILED DESCRIPTION OF THE PREFERRED EMBODIMENTS

Figure 1:
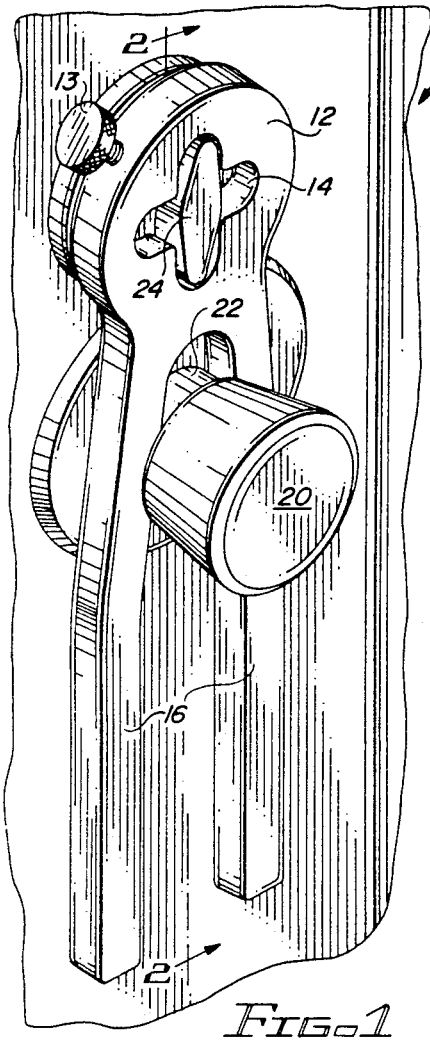
FIG. 1 is a perspective of the locking device of the present invention shown engaged upon a dead bolt latch knob and door knob.

The removable latch bolt locking device 10 of the present invention is best illustrated with reference to the accompanying Drawings, in which like features are identified by like reference numerals. Locking device 10 may be easily engaged upon a wide variety of door configurations, including, for example, doors having knobs, handles or neither of the foregoing. Additionally, locking device 10 will have utility with a wide variety of dead bolt latch knobs having vertical, horizontal or angular orientations and throws. The locking device 10 is easily removable and may be carried about for security purposes while traveling.

Figure 2:
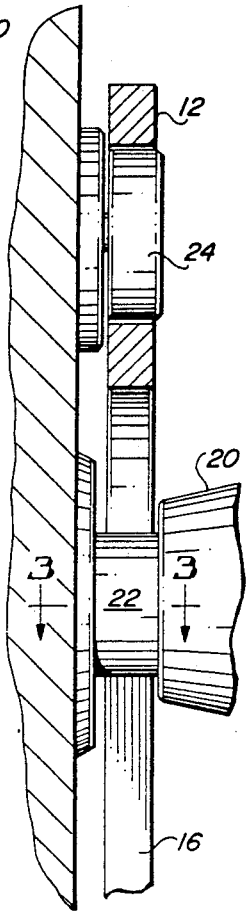
FIG. 2 is a side elevational cross-sectional view of the locking device of the present invention taken along line 2—2 of FIG. 1.
Figure 3:
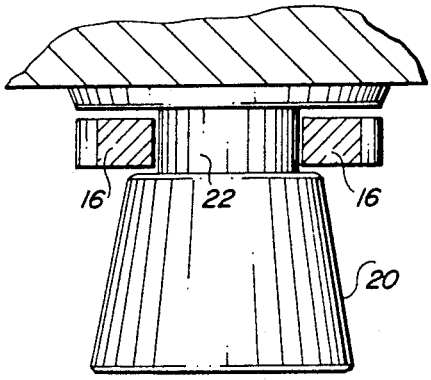
FIG. 3 is a cross-sectional view of the locking device of the present invention taken along line 3—3 of FIG. 2.

As best illustrated with reference to FIGS. 1–3, locking device 10 consists primarily of a head portion 12 and a pair of downwardly projecting leg members 16. Head portion 12 has an aperture 14 which is adapted to engage a dead bolt knob 24 in secure fashion. It is desirable for additional security, though not required, to provide positive locking means 13 operably associated with the head portion 12. Locking means 13 may consist of any type of means for directly engaging the dead bolt knob 24 and frictionally engage the knob 24 within the aperture 14. The downwardly projecting leg members 16 define a space therebetween which engages a shank 22 of a door knob 20. Those skilled in the art will appreciate, that the downwardly projecting leg members 16 may also accommodate a vertically oriented door handle (not shown) therebetween. Downwardly projecting leg members 16 serve to resist lateral displacement of the locking device by abutting the door knob shank 22 or the door handle (not shown) and therefore offer resistance to turning of the dead bolt knob 24.

In operation, the user engages the downwardly projecting leg members 16 about the door knob 20 or handle (not shown) therebetween, and engages the dead bolt knob 24 within aperture 14. As additional security and to further facilitate a locking engagement of the head portion 12 and the dead bolt knob 24, it is desirable to positively engage the dead bolt knob 24 with locking means 13. According to a preferred embodiment of the present invention, positive locking means 13 is a set screw, which passes through a threaded bore in the head portion 12 and into aperture 14. The positive locking means 13 serves to frictionally engage the dead bolt knob 24 against the wall of aperture 14, thereby minimizing movement of the dead bolt knob 24 within aperture 14.

Figure 4:
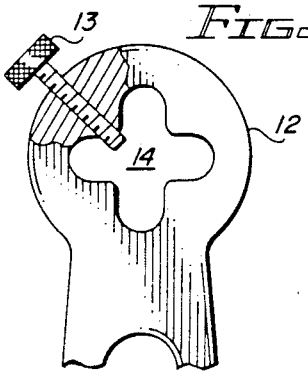
FIG. 4 is a fragmentary, partial cut-away view of a head portion of the locking device of the present invention.
Figure 5:
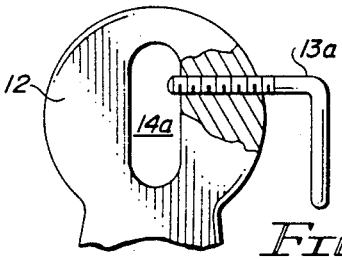
FIG. 5 is a fragmentary, partial cut-away view of an alternative embodiment of a head portion of the locking device of the present invention.
Figure 6:
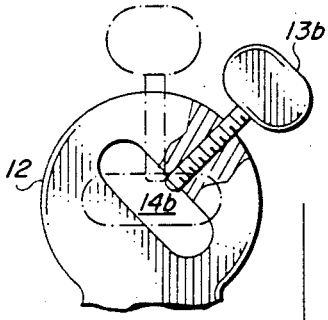
FIG. 6 is a fragmentary, partial cut-away view of another alternative embodiment of a head portion of the locking device of the present invention.
Figure 8:
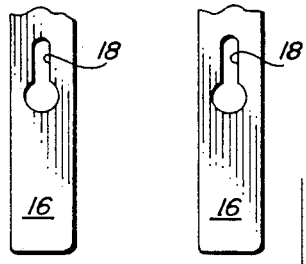
FIG. 8 is a fragmentary view of the leg portions of the locking device of the present invention.

Those skilled in the art will understand that dead bolt knobs 24 have a variety of locking positions. With most of the existing dead bolt hardware, the dead bolt knob 24 is in either a horizontal or vertical position when the dead bolt latch is engaged. However, with some of the newer dead bolt hardware, the dead bolt knob 24 is in an angularly displaced position. To assure that the present invention has widespread utility, in accordance with the preferred embodiments, and as illustrated with reference to FIGS. 4–6, the head portion 12 may have a cruciform shaped aperture 14, a vertically oriented aperture 14*a* or a horizontally oriented aperture 14*b*. The cruciform shaped aperture 14, when vertically oriented, will accommodate both vertically and horizontally positioned dead bolt knobs 24, while the vertically shaped aperture 14*a* and the horizontally shaped aperture 14*b* will, of course, only engage upon a vertically or horizontally positioned dead bolt knob 24, respectively. To accommodate an angularly displaced dead bolt knob 24, the locking device 10 may be made with an angularly displace cruciform shaped aperture 14 in head portion 12, or an angularly displaced vertical aperture 14*a* or horizontal aperture 14*b* in the head portion 12. As with the prior described preferred embodiment, positive locking means 13 may also be provided.

Positive locking means 13 may consist of a threaded bolt set screw, as illustrated in the accompanying Drawings. Those skilled in the art will, however, understand and appreciate that other well known types of positive locking mechanisms of similar function may be substituted and are within the contemplated scope of the present invention. For example, positive locking means 13 may consist of a spring actuated pin which positively engages the dead bolt knob 24 against the wall of aperture 14.

Figure 9:
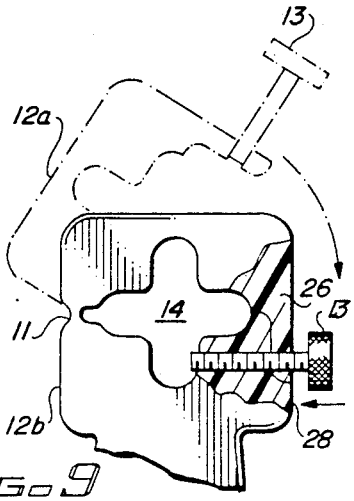
FIG. 9 is a fragmentary partial cut-away view of another alternative embodiment of a head portion of the locking device of the present invention.

According to an alternative embodiment of the present invention and as illustrated with reference to FIG. 9, there is shown a head portion 12 having an upper head member 12*a* and a lower head member 12*b*. According to this embodiment of the locking device 10, upper head member 12*a* articulates with respect to lower head member 12*b* by a molded live hinge 11 which interconnects upper and lower head member 12*a* and 12*b*. Each of upper and lower head members 12*a* and 12*b* have an associated coupling means 26 and 28, which serve to securely couple upper head member 12*a* to lower head member 12*b* in a closed position. Coupling means 26 and 28 may be any type mechanism for engaging upper head member 12*a* with lower head member 12*b*. For example an appropriate snap fit coupling or a tooth and rail coupling may be used. A positive locking means 13 may also be provided.

In operation, the device 10 of this embodiment is engaged upon a shank 22 of a door knob 20 and the dead bolt knob 24 is positioned within aperture 14. The upper head member 12*a* is closed around the dead bolt knob 24 and securely coupled, via coupling means 26 and 28, to lower head member 12*b*. Optionally, the positive locking means 13 may be utilized to frictionally engage the dead bolt knob 24 against the walls of aperture 14.

From the foregoing, it will be understood by those skilled in the art, that the head portion 12 and aperture 14 may be manufactured in multiple configurations to accommodate various dead bolt knob 24 locking positions. Moreover, head portion 12 may be manufactured of a single integral material, or be made of mating pieces which couple about the dead bolt knob 24.

Figure 7B:
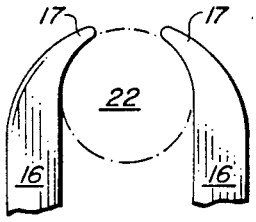
FIG. 7B is a fragmentary view of the leg portions of an at rest locking device engaged about a door knob shank.
Figure 7A:
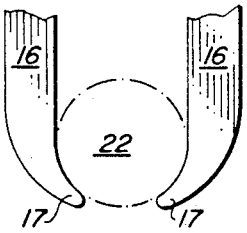
FIG. 7A is a fragmentary view of the leg portions of an in use locking device engaged about a door knob shank.

As illustrated with reference to FIG. 1, leg members 16 extend downwardly from the head portion and form a space therebetween which is adapted to engage a door knob shank 22 or a door handle (not shown). According to an alternative preferred embodiment, as illustrated with reference to FIGS. 7A and 7B, leg members 16 may terminate in end members 17 which are deformed toward the central axis of the locking device. By providing inwardly deformed end members 17, the locking device 10 may be disengaged from the dead bolt knob 24 and allowed to hang upon the door knob shank 22, when the locking device 10 is at rest. Alternatively, when the locking device 10 is in use, the inwardly deformed end members 17 serve to offer resistance to inadvertent disengagement of the device 10 from the door knob shank 22. Thus, it is desirable, although not necessary, to configure the leg members 16 with inwardly deformed end members 17.

Finally, to permit the locking device 10 to have utility with door installations without any interior door knob or door handle, each of the downwardly projecting leg members 16 has an opening 18, such as a slot or a keyhole opening, in the body thereof. Because there will be no door knob or door handle to offer resistance against lateral displacement of the locking device when the dead bolt knob 24 is turned, the user installs a pair of screws or nails into the door, and the openings 18 are engaged thereupon. In this manner, any attempt to turn the dead bolt knob 24 will be resisted due to the engagement of the openings 18 of leg members 16 upon the screw or nail in the door.

The above-described locking device 10 is preferably constructed of a plastic or lightweight metal material. Additionally, it is desirable, though not essential, that the entire locking device be made of a single integral piece of material. Because most doors have a substantially co-planar relationship between the door knob shank 22 and the dead bolt knob 24, it has been found desirable to construct locking device 10 such that the head portion 12 and the leg members 16 are in a co-planar relationship. Those skilled in the art will understand and appreciate that various changes and modifications may be made to the above-described invention and still fall within the spirit and scope of the invention, which is intended to be limited only by the accompanying claims.

I claim:

1. A locking device for locking a dead bolt latch knob in a fixed position, comprising:

a substantially planar, integrally formed member, having a continuous outer wall substantially perpendicular to the plane of said member, said member comprising a fixed head portion having an aperture passing therethrough, wherein said aperture is defined by a continuous inner wall substantially perpendicular to the plane of said substantially planar head portion, formed within said substantially planar head portion and is adapted to receive and engage the dead bolt latch knob therein; and a pair of downwardly projecting coplanar leg members defining an opening therebetween, for engaging opposing sides of a door knob shaft;

a bore passing laterally through said continuous outer wall and communicating with said continuous inner wall of said aperture in said head portion; and locking means operably disposed in said bore for frictionally locking the dead bolt knob against said continuous inner wall of said aperture in said head portion.

2. The locking device according to claim 1, wherein said aperture further comprises a cruciform shaped opening in said head member.

3. The locking device according to claim 1, wherein said aperture further comprises a vertical opening in said head member.

4. The locking device according to claim 1, wherein said aperture further comprises a horizontal opening in said head member.

5. The locking device according to claim 1, wherein said aperture further comprises an opening angularly displaced from vertical.

6. The locking device according to claim 1, wherein said head member further comprises an upper head member and a lower head member, said lower head member being coupled to each of said downwardly extending leg members, and said upper head member being coupled to said lower head member in articulating fashion; each of said upper head member and said lower head member having recesses defining portions of said aperture; said device further comprising coupling means for removably coupling said upper head member to said lower head member thereby defining said aperture therein.

7. The locking device according to claim 1, wherein said locking means further comprises a set screw, and said bore further comprises an internally threaded bore.

8. The locking device according to claim 1, wherein said leg members each further comprise terminal end members deformed toward a central axis of said device.

9. The locking device according to claim 1, wherein said leg member each further comprises at least one aperture passing therethrough.

10. An apparatus for locking a reciprocating latch bolt of a door in combination with a latch bolt knob, comprising:

a fixed head member having a cruciform-shaped opening passing therethrough adapted to engage the latch bolt knob in either a vertical or horizontal orientation and in a substantially locked condition, said head member further having a bore passing diagonally through said head member and communicating between said cruciform-shaped opening and an exterior peripheral surface of said head member;

a pair of co-planar downwardly projecting leg members, said leg members being co-planar with said head member and forming a longitudinal slot therebetween for engaging a door knob shank therein, said leg members each having a lower end inwardly tapered toward said longitudinal slot, thereby narrowing said longitudinal slot between said lower ends, wherein said head member and said pair of co-planar downwardly projecting leg members are formed of a single integral piece of material; and locking means for resisting movement of said head member when the latch bolt knob is turned, said locking means being operably coupled to said bore passing through said head member and laterally projecting into said cruciform opening.

11. The apparatus according to claim 10, wherein said head member further comprises an upper head member and a lower head member, said lower head member being coupled to each of said downwardly extending leg members, and said upper head member being coupled to said lower head member in articulating fashion; each of said upper head member and said lower head member having recesses defining portions of said opening; said apparatus further comprising coupling means for removably coupling said upper head member to said lower head member thereby defining said opening therein.

12. The apparatus according to claim 10, wherein said locking means further comprises a set screw, and said bore further comprises an internally threaded bore.

13. The apparatus according to claim 10, wherein said leg member each further comprise at least one aperture passing therethrough.

* * * * *